United States Patent [19]

Batra

[11] 4,398,357

[45] Aug. 16, 1983

[54] OUTSOLE

[75] Inventor: Vijay K. Batra, Sharon, Mass.

[73] Assignee: Stride Rite International, Ltd., Cambridge, Mass.

[21] Appl. No.: 270,795

[22] Filed: Jun. 1, 1981

[51] Int. Cl.[3] ..... A43B 13/12; A43B 13/16

[52] U.S. Cl. ..... 36/30 A; 36/31; 36/14; 36/129

[58] Field of Search ..... 36/12, 14, 15, 25 R, 36/30 R, 32 R, 114, 126, 127, 128, 129; 36/30 A, 31

[56] References Cited

U.S. PATENT DOCUMENTS

| | | | |
|---|---|---|---|
| 59,357 | 11/1866 | Case | 36/30 R |
| 184,077 | 2/1876 | Hanshew | 36/30 A |
| 318,209 | 5/1885 | Schmid | 36/30 R |
| 468,223 | 2/1882 | Hess | 36/30 R |
| 1,507,844 | 9/1924 | Mason | 36/30 R |
| 1,592,445 | 7/1926 | Cutler | 36/30 R |
| 1,607,896 | 4/1923 | Kelly | 36/30 R |
| 2,089,170 | 2/1936 | Bain | 36/25 |
| 2,251,468 | 4/1939 | Smith | 36/32 |
| 3,566,486 | 3/1971 | Conway | 36/114 |
| 4,302,892 | 12/1981 | Adamik | 36/30 R |
| 4,316,332 | 2/1982 | Giese | 36/30 R |

FOREIGN PATENT DOCUMENTS

| | | | |
|---|---|---|---|
| 660551 | 11/1935 | Fed. Rep. of Germany | 36/30 R |
| 1108501 | 8/1955 | France | 36/25 R |

*Primary Examiner*—Werner H. Schroeder
*Assistant Examiner*—Steven N. Meyers

[57] ABSTRACT

Outsole for a shoe including a first sole component molded of a relatively dense natural or synthetic rubber composition and having a cut-out shank region and a second sole component of a relatively less dense organic plastic material filling the cut-out shank region of the first sole component.

6 Claims, 6 Drawing Figures

FIG 1
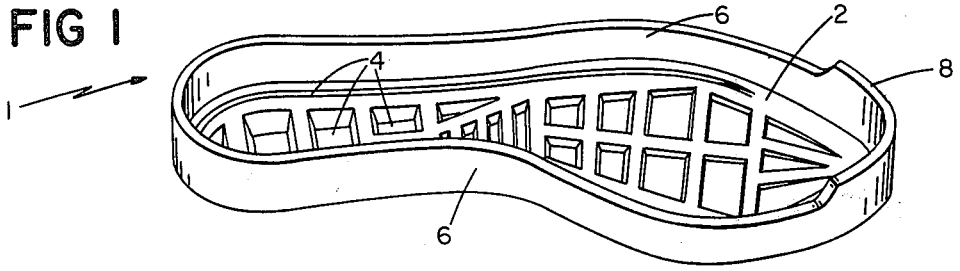
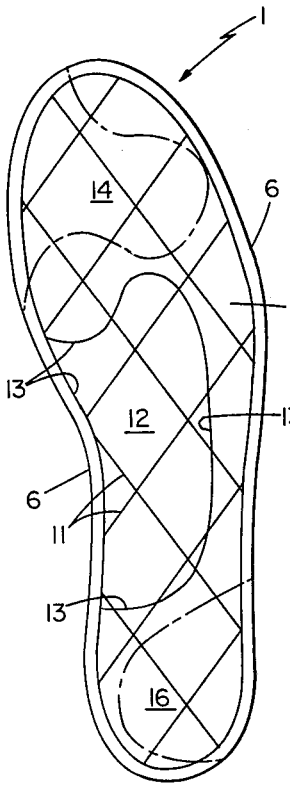
FIG 2
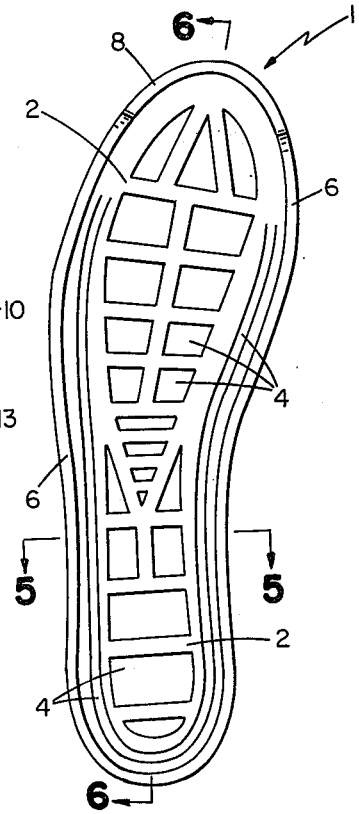
FIG 3
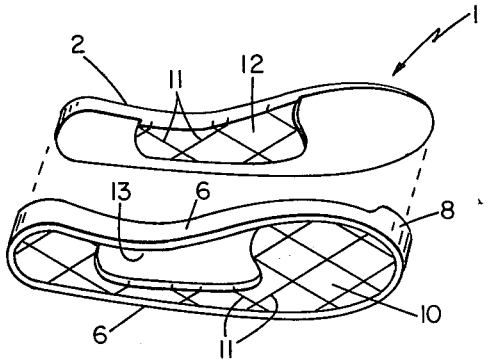
FIG 4
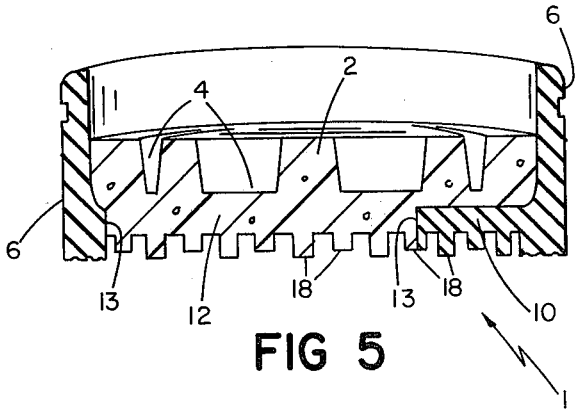
FIG 5
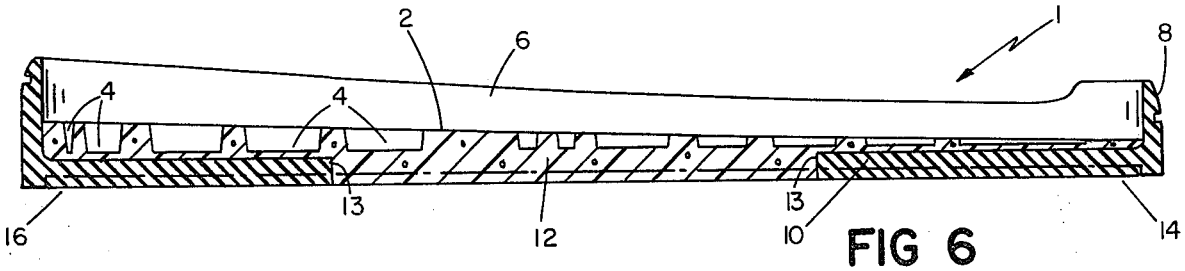
FIG 6

OUTSOLE

BACKGROUND OF THE INVENTION

This invention relates to outsoles for shoes or boots. It is desirable that the outsoles for many types of footwear, e.g., athletic and work shoes, be durable and light in weight.

SUMMARY OF THE INVENTION

In general, the present invention features an outsole including a first sole component molded of a relatively dense natural or synthetic rubber composition and having a cut-out shank region, and a second sole component of a relatively less dense organic plastic material filling the cut-out shank region of the first sole component.

In preferred embodiments the second sole component forms a layer overlying and bonded to the upper surface of the first sole component; the first sole component is a natural rubber composition and the second component is a polyurethane composition; the second component is thicker at the heel than at the toe; the bottom surface of the outsole bears treads; the second sole component has a plurality of recesses; and the first sole component includes a rim.

The less dense sole component of the outsole of the invention provides a desirable reduction in weight—as high as 25% or even higher—while providing good durability by virtue of the positioning of the exposed area of the less dense material in the shank region, which is least subject to wear, and the more dense materials in the heel and ball areas most subject to wear. The resilience of the less dense composition in the shank area also provides desirable shock absorption in that area.

In the preferred embodiment wherein the less dense composition overlies the denser composition, the less dense material provides shock absorption over the entire area of the sole. The insert/overlay design of that embodiment also provides excellent bonding between the two sole components.

Other advantages and features of the invention are apparent from the description of the preferred embodiment thereof, and from the claims.

PREFERRED EMBODIMENT

The structure and operation of a preferred embodiment of the invention will now be described, following a brief description of the drawings.

DRAWINGS

FIG. 1 is a perspective view of an outsole of the invention.

FIG. 2 is a plan view of the bottom of said outsole.

FIG. 3 is a plan view of the inner surface of said outsole.

FIG. 4 is an exploded view of said outsole.

FIG. 5 is a sectional view of said outsole taken at 5—5 of FIG. 3.

FIG. 6 is a sectional view of said outsole taken at 6—6 of FIG. 3.

STRUCTURE AND OPERATION

There is shown in FIGS. 1–6 outsole 1 in which polyurethane sole component 2 overlies and is inserted into relatively denser, ¼ inch thick rubber composition sole component 10, having integral raised rim 6 whose front portion extends upward beyond the remainder of the rim to form toe protector 8. The upper surface of sole component 2 includes a plurality of recesses 4, arranged in a regular pattern to provide optional shock absorption and weight reduction. As is shown in FIG. 6, the portion of sole component 2 overlying sole component 10 tapers from ¼ inch thick at the heel to 1/32 inch thick at the toe, and the depths of recesses 4 vary accordingly.

As is shown in FIGS. 2, 4, and 6, the integral insert portion 12 of sole component 2 fills cut-out portion 13 of sole component 10 and, as is shown in FIGS. 5 and 6, extends to, but not beyond, its bottom edge. The shape of cut-out portion 13 approximates the shape of the arch, or instep, of the average foot. The bottom of the outsole 1 bears a tread, shown diagrammatically in FIG. 2 as a cross-hatching 11, and in FIG. 5 as ridges 18, whose pattern is continuous on the bottom of sole components 10 and 12.

Referring to FIG. 2, regions 14 and 16 of the bottom of outsole 1 represent those areas subject to the greatest wear. The bottom surface of the outsole, in these regions, is composed of the relatively dense, more durable rubber composition. In shank region 12, the region subject to the least wear, the bottom surface of the outsole is composed of the less dense, less durable polyurethane composition. Thus, outsole 1 of FIG. 1 offers the durability of the rubber composition and the resiliency, shock absorption, and light weight of the polyurethane composition, while minimizing the disadvantages of both. The regular pattern of recessed areas of the less dense composition provides a further reduction in weight, and provides shock absorption as well. As an illustration of the weight reduction provided by the above-described structure, the sole of a size 9 basketball shoe made without using the less dense sole component weighs approximately 200 grams. In contrast, a size 9 basketball shoe sole having the structure described above weighs only 140 grams, representing a weight reduction of 33%.

MANUFACTURE

The outsole of FIG. 1 is made by first molding, in a flat press, a natural rubber composition containing butadiene, zinc oxide, stearic acid, magnesium carbonate, sulphur, styrenated phenol, butylated hydroxy toluene, titanium dioxide, and ultramarine blue. The press is adapted to impart a desired tread pattern to the bottom of the outsole. After drying, the shank region (area 13, FIG. 4) is cut out and the rubber sole component cleaned. Primer (C-5 type) and a flowable cement (C-7 type) are then applied to the inside surface of the rubber sole component, and a liquid polyurethane composition containing isocyanate poured onto the sole to fill the cut-out shank area and form a layer of polyurethane overlying the rubber sole component. The bottom of the polyurethane insert portion (insert 12, FIG. 4) is, by this process, molded into the same tread design as the bottom of sole component 10. The overlying polyurethane layer is molded to be thicker at the heel than at the toe. The composite sole, when dried and removed from the mold, exhibits excellent bonding between the two sole components, by virtue of the insert/overlay design.

OTHER EMBODIMENTS

Other embodiments are within the following claims. For example, liquid sole compositions can be injected, rather than poured, into the mold. The molding process can be adapted to provide the cut-out region of the first sole component, obviating a cutting out step. The materials used in the sole components can be any suitable materials which embody the required density relationship; e.g. the first component can be any suitable natural or synthetic rubber composition, and the second component any suitable organic plastic material. Further, the outsole can be used in conjunction with any type of shoe or boot, e.g., athletic or work shoes, in which the advantages of the invention are desired.

What is claimed is:

1. An outsole for a shoe or boot comprising a first sole component, molded of a relatively dense natural or synthetic rubber composition and having a cut-out shank region, and a second sole component, of a relatively less dense organic plastic composition, filling said cut-out shank region of said first sole component, wherein the bottom surfaces of said first and second sole components form a continuous surface which bears tread of a continuous pattern.

2. The outsole of claim 1 wherein said first sole component includes a rim portion, said rim portion being of sufficient height to encase and retain said second sole component, rising above said second sole component at the toe.

3. The outsole of claim 1 said first sole component is of a natural rubber composition, and said second sole component is of a polyurethane composition.

4. The outsole of claim 1 wherein said second sole component has a plurality of recesses arranged in a regular pattern on its inner surface.

5. The outsole of claim 1 wherein the shape of said cut-out shank region approximates the shape of the arch of the foot.

6. The outsole of claim 5 wherein said cut-out shank region extends to the medial, but not lateral, edge of said outsole, covers the major portion of the width of the shank region, is longer than it is wide, has a lateral edge which is generally parallel to the lateral edge of said outsole, has a forward edge which is generally S-shaped to curve around the inward periphery of the ball area of the foot, and is generally curved at the edge nearest the heel.

* * * * *